US008989424B2

(12) United States Patent
Sibbald et al.

(10) Patent No.: US 8,989,424 B2
(45) Date of Patent: Mar. 24, 2015

(54) EARPHONE ARRANGEMENTS

(75) Inventors: Alastair Sibbald, Cookham Dean (GB); Martin Howle, Kenilworth (GB)

(73) Assignee: Incus Laboratories Limited, Stokenchurch Buckinghamshire (GB)

( * ) Notice: Subject to any disclaimer, the term of this patent is extended or adjusted under 35 U.S.C. 154(b) by 423 days.

(21) Appl. No.: 13/555,310

(22) Filed: Jul. 23, 2012

(65) Prior Publication Data

US 2013/0028434 A1 Jan. 31, 2013

(30) Foreign Application Priority Data

Jul. 29, 2011 (GB) ..... 1113075.4

(51) Int. Cl.
*H04R 25/00* (2006.01)
*H04R 1/10* (2006.01)

(52) U.S. Cl.
CPC ..... *H04R 1/10* (2013.01)
USPC ..... 381/373; 381/371

(58) Field of Classification Search
USPC ..... 381/71.6, 328, 370, 371, 373, 376, 380; 379/430; 455/575.2
See application file for complete search history.

(56) References Cited

U.S. PATENT DOCUMENTS 4,239,945 A 12/1980 Atoji et al.
4,852,177 A * 7/1989 Ambrose ..... 381/338
2004/0136543 A1* 7/2004 White et al. ..... 381/74
2007/0189569 A1* 8/2007 Haapapuro et al. ..... 381/380
2009/0161885 A1* 6/2009 Donaldson et al. ..... 381/71.6

FOREIGN PATENT DOCUMENTS

GB 2394619 A 4/2004
JP 01101795 A 4/1989
JP 2005191663 A 7/2005
JP 2011087048 A 4/2011

OTHER PUBLICATIONS

GB Search Report for GB Application No. GB113075.4, Dec. 5, 2011.

* cited by examiner

*Primary Examiner* — Tuan D Nguyen
(74) *Attorney, Agent, or Firm* — Paul D. Bianco; Martin Fleit; Fleit Gibbons Gutman Bongini & Bianco PL

(57) ABSTRACT

The present invention relates to earphone arrangements configured to accommodate an acoustically-resistant couple within the compact dimensions of ear-bud type earphones, and aims to incorporate a front volume to rear volume acoustic couple into an earphone without requiring significant addition to the lateral dimensions of the earphone. The earphone has an elongate sound outlet port that locates into a listener's ear canal and bears an internal support surface which is apertured and communicates with the outlet port. A microspeaker is supported on the support surface and projects sound through the aperture and toward the outlet port. Furthermore, the housing includes a front cavity in front of the microspeaker and in communication with the outlet port, and a rear cavity behind the microspeaker. The support surface bears a recess that communicates with the front cavity, and an acoustic resistor is accommodated in the recess.

13 Claims, 8 Drawing Sheets

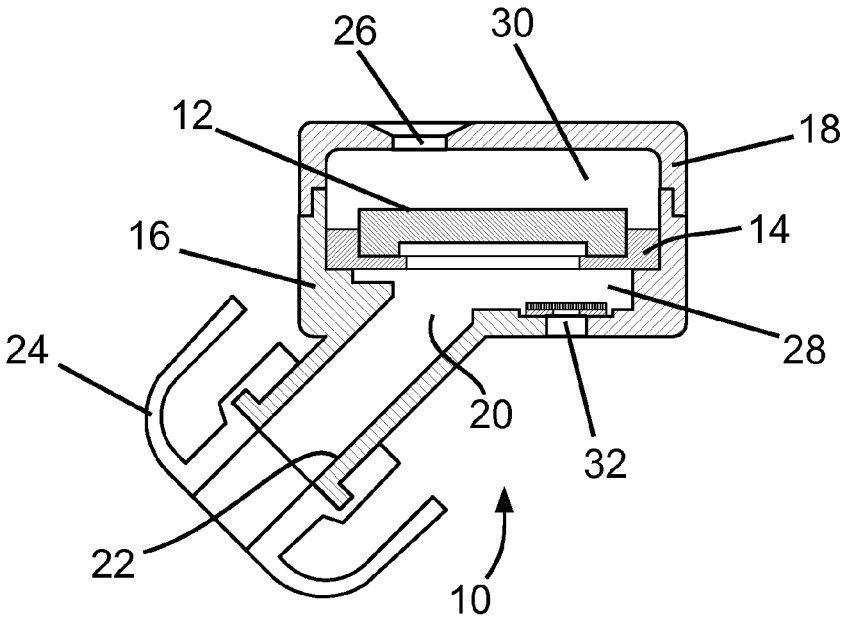
Fig 1: PRIOR ART
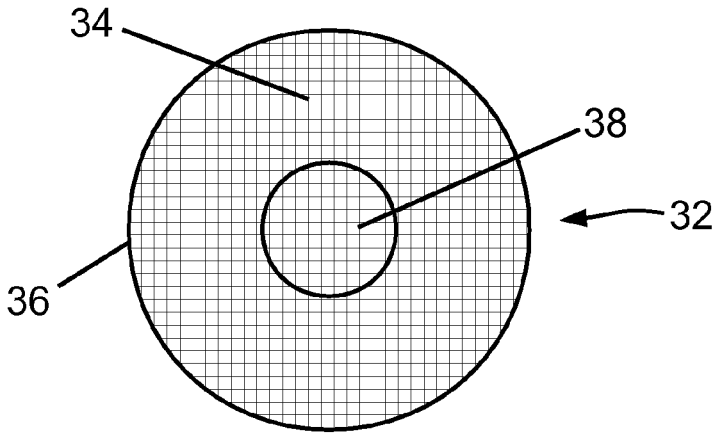
Fig 2(a): PRIOR ART
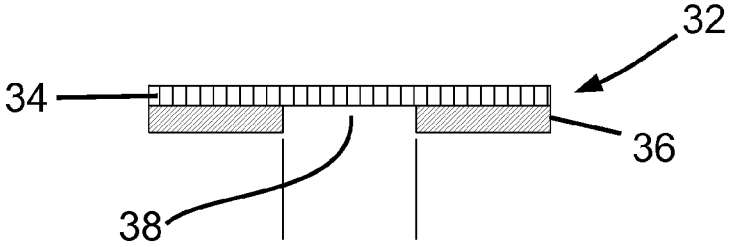
Fig 2(b): PRIOR ART

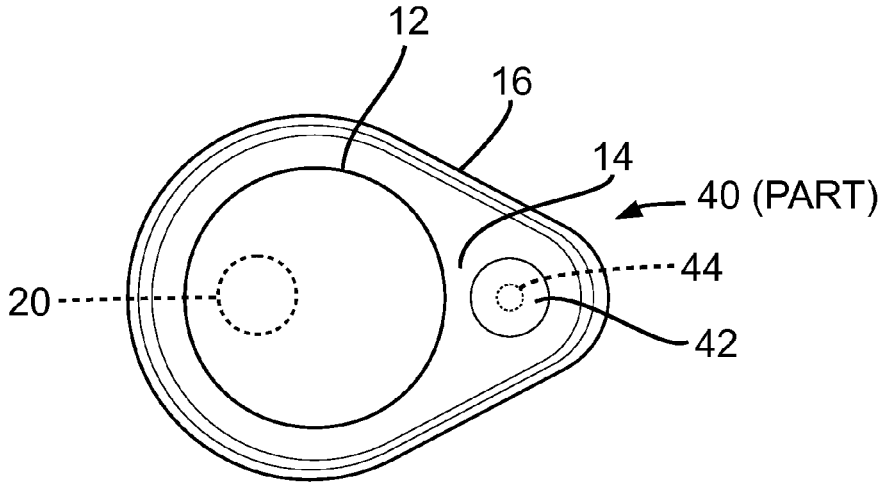
Fig 3(a): PRIOR ART
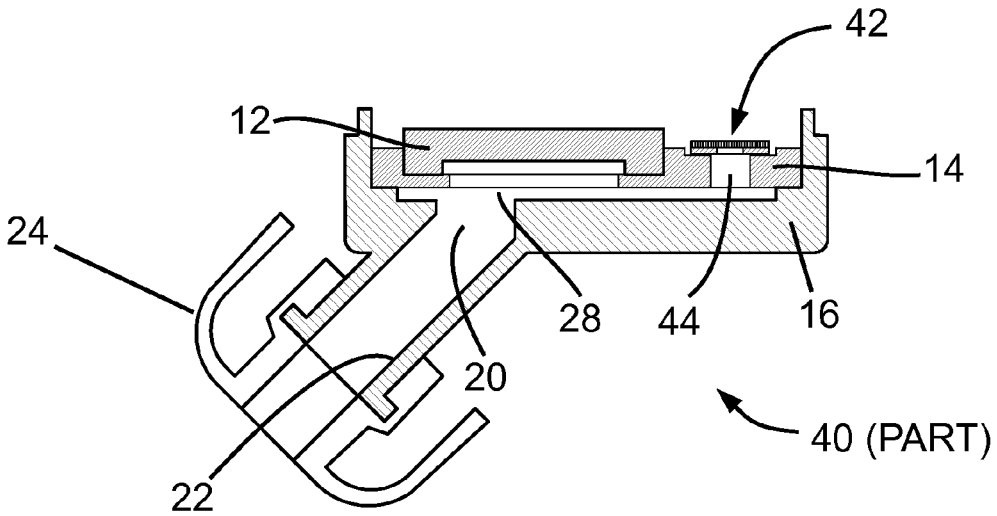
Fig 3(b): PRIOR ART

EARPHONE ARRANGEMENTS

CROSS REFERENCE TO RELATED APPLICATIONS

This applications claims priority to United Kingdom patent application No. GB 1113075.4, filed Jul. 29, 2011, the entire contents of which are herein incorporated by reference.

FIELD OF THE INVENTION

The present invention relates to earphone arrangements, and it relates in particular to such arrangements as are configured to accommodate an acoustically-resistant couple within critical spatial constraints of the kind dictated by the compact dimensions of ear-bud type earphones.

BACKGROUND OF THE INVENTION

Acoustically-resistant couples play a significant role in determining and adjusting the acoustic characteristics and performance of earphones, especially when a particular frequency response characteristic is required. This is especially the case in the design of earphones which feature electronic ambient noise-cancellation (ANC) technology, and specifically to those utilising "ear-bud" type thin rubber flanges that seal the outlet conduit of the earphone into the entrance of the listener's ear-canal. Such earphones are sometimes referred to as "in-ear" earphones, or "ear-bud type" earphones, and they are now widely used for portable communications and entertainment applications whilst the listener is travelling, including listening to music and, in conjunction with cellular telephone handsets, for hands-free calls and conversations.

Although the thin rubber ear-bud flanges might appear to effectively "seal" the earphone assembly into the listener's ear-canal, an earphone thus positioned and located does not provide an effective acoustic seal between the listener's ear canal and the ambient environment, because low-frequency sound vibrations can still pass through the rubber flanges themselves. In addition, as already mentioned, and as disclosed for example in U.S. Pat. No. 4,852,177, acoustically-resistant couples are often incorporated into acoustic coupling pathways that are provided in earphone structures so as to adjust the acoustic performance for a desired frequency response at the listener's ear, and such pathways allow external sound energy to be transmitted directly through the actual structure of the earphone and into the ear-canal. Acoustic coupling pathways are often implemented as small apertures, with acoustical resistance provided by an acoustically resistive mesh material overlying an aperture. Such pathways are usually situated to provide an acoustic connection either between the outer ambient air and the internal space situated at the front surface of an internal microspeaker (or in the space behind it), or between these two internal spaces themselves, or some combination thereof, and these pathways contribute to the complexity of the acoustic structure of the earphone.

The general structure of a prior-art ear-bud type earphone 10 is shown in FIG. 1, in which a microspeaker 12 is sealed into a central substrate 14, which, in turn, is sealed to both a front housing 16 and a rear housing 18. The front housing 16 includes an elongate outlet port comprising an inner opening 20 coupled to an in-ear extension piece 22 on to which a rubber ear-bud flange 24 is affixed, and the rear housing 18 often is formed with one or more rear vents, such as 26, linking the rear of the microspeaker 12 to the external ambient. It is convenient to refer to the volume of air in the front housing 16, lying between the front of the microspeaker 12 and the inner opening 20 of the outlet port, as the "front volume" 28, and to the volume of enclosed air lying in the rear housing 18 behind the microspeaker 12 as the "rear volume" 30. The rear housing 18 is also used to carry and locate the electrical flex connections to and from the microspeaker 12, though these are not shown, for reasons of clarity.

As already mentioned, it is usual to provide the earphone 10 with one or more vents or acoustically-resistant couples, such as that shown at 32, in order to modify the frequency response to provide, for example, high-quality sound reproduction. Such couples usually include acoustic resistors, formed by sealing a thin, acoustically resistant nylon mesh (or similar) over a small diameter (<1 mm), short length (<1 mm) aperture in the housing. This is often done by means of small, double-sided adhesive tape discs, as illustrated in FIG. 2, which shows an acoustic resistor 32, comprising a nylon mesh disc 34 mounted on to an adhesive disc 36 in which there is a central aperture 38 defining the active area of the acoustic resistor 32.

Typically, the disc 34/36 has an outer diameter of 3 mm, and a central aperture of 1 mm. It is beneficial to deploy such a resistance either between the front volume 28 and the ambient, as shown in FIG. 1, or between the front and rear volumes 28, 30. This expedient provides an additional benefit, in preventing a total hermetic seal of the earphone in the ear of the user, which could otherwise cause an unpleasant "blocked ear" feeling in use.

Further, the provision of a pathway between the ear-canal and the ambient (either directly or via the rear volume 30) allows air to escape from the ear-canal when the ear-bud 10 is inserted. This prevents damage to the microspeaker 12 as, without such a pathway, the air in the canal and front volume 28 would be momentarily compressed, and this could force the diaphragm of the microspeaker 12 beyond its mechanical limits, potentially buckling the diaphragm and causing permanent damage.

In practise, only one of these acoustic couples is required to avoid the above problems: either a front volume-to-ambient couple, or a front volume to rear volume couple (assuming that the rear volume itself is also vented). The present invention utilises an acoustic couple between the front volume and the rear volume.

When it is required to implement a front volume to rear volume acoustic couple, such as in the acoustic module design disclosed in GB-A-2,475,526, it is convenient to position the elements of the acoustic couple directly adjacent to the microspeaker 12. This is illustrated in FIGS. 3(*a*) and 3(*b*), in which features corresponding to those already described with reference to FIGS. 1 and 2 are identified by the same reference numbers. FIG. 3 shows only part of an earphone 40, comprising a front housing 16 and its contents, but it will be appreciated that a rear housing, such as that shown at 18 in FIG. 1, would be attached to the front housing 16 to form an enclosed unit defining a vented rear volume, such as that shown at 26, 30 in FIG. 1.

In FIGS. 3(*a*) and 3(*b*), the front housing 16 of an earphone shown in part at 40 includes an acoustic resistor 42 mounted over an aperture 44 formed in the substrate 14, beside the aperture provided for the microspeaker 12, thereby providing an acoustic leakage path, via the resistor 42, between the front volume 28 and the rear volume (not shown in FIG. 3) of air in the earphone. However, this layout increases the lateral dimensions of the earphone 40 significantly beyond those needed to accommodate the microspeaker 12, as is clear from the drawing. In addition to the area of the acoustic resistor 42, which may typically have a diameter of around 3 mm, it is necessary to allow for manufacturing clearances around the edges of the individual components, and consequently the overall lateral dimensions of an earphone such as 40 are considerably larger than those of an earphone such as that shown at 10 in FIG. 1.

It is one object of the present invention to provide an earphone which incorporates a front volume to rear volume acoustic couple, without requiring significant addition to the lateral dimensions of the earphone.

SUMMARY OF THE INVENTION

According to the invention from one aspect there is provided an earphone arrangement comprising an earphone housing having an elongate sound outlet port dimensioned and configured to locate into a listener's ear canal and bearing an external flange of resilient material thereon for intimate contact with said ear canal; the housing bearing, internally thereof, a support surface formed with an aperture therethrough communicating with said outlet port; the arrangement further including a microspeaker supported on said support surface and located to project sound through said aperture and toward said outlet; the housing comprising a front cavity in front of said microspeaker and in communication with said outlet port and a rear cavity behind said microspeaker; said support surface being further formed with a recess therein communicating with said front cavity, said recess accommodating an acoustic resistor; wherein the microspeaker overlies at least a substantial part of said recess, and the arrangement further comprises a channel linking said front and rear cavities acoustically by way of said acoustic resistor.

By having the microspeaker overlay, at least to a substantial extent, the recess containing the acoustic resistor, the invention facilitates the provision of acoustically resistant couple between the first (front) and second (rear) cavities without significantly increasing the lateral dimensions of the earphone housing.

Preferably, the recess and the acoustic resistor therein are completely overlain by the microspeaker.

In some preferred embodiments of the invention, said channel comprises a first portion formed partly in the base of said recess underlying said acoustic resistor, and a second portion, substantially orthogonal to the first, running past an edge of said microspeaker and linking the first portion to the rear cavity.

In some such embodiments, the first portion of said channel is substantially linear, thereby minimising the overall length of the channel. In other preferred embodiments, the first portion of said channel is extended to follow an arcuate path beneath an edge of said microspeaker, thereby to extend the overall length of said channel.

Preferably, the microspeaker has a circular footprint on said support surface.

Preferably, the said aperture is circular in plan, and further preferably said recess and said acoustic resistor are also circular in plan. In other preferred embodiments, however, the recess and/or the acoustic resistor may be non-circular (e.g. square) in plan.

Preferably, the housing is apertured to provide a port venting said rear cavity to the ambient. Such a port may be fitted with an acoustic resistor.

In some preferred embodiments, the said venting port is located at a significant distance from an opening into the rear cavity of said second portion of the acoustic channel.

In preferred embodiments of the invention, the earphone arrangement is further provided with a microphone means for detecting ambient noise, and with electrical connections to and from an ambient noise cancelling device.

BRIEF DESCRIPTION OF THE DRAWINGS

In order that the invention may be clearly understood and readily carried into effect, embodiments thereof will now be described, by way of example only, with reference to the accompanying drawings of which:

FIGS. 1 to 3 have already been referred to in relation to discussion of prior art, and show respectively:

in FIG. 1, a cross-sectional view of a prior art earphone with a front-to-ambient acoustic couple;

in FIGS. 2(*a*) and 2(*b*), plan and cross-sectional views respectively of a typical acoustic resistance; and in FIGS. 3(*a*) and 3(*b*), plan and cross-sectional views respectively of a prior art earphone arrangement with a front-to-rear acoustic couple;

DETAILED DESCRIPTION OF THE INVENTION

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

One embodiment of the invention will now be described, by way of example only, with reference to FIGS. 4(*a*) and 4(*b*), FIG. 5, and FIGS. 6(*a*), 6(*b*) and 6(*c*), in all of which similar components are identified by the same reference numbers.

Figure 4A:
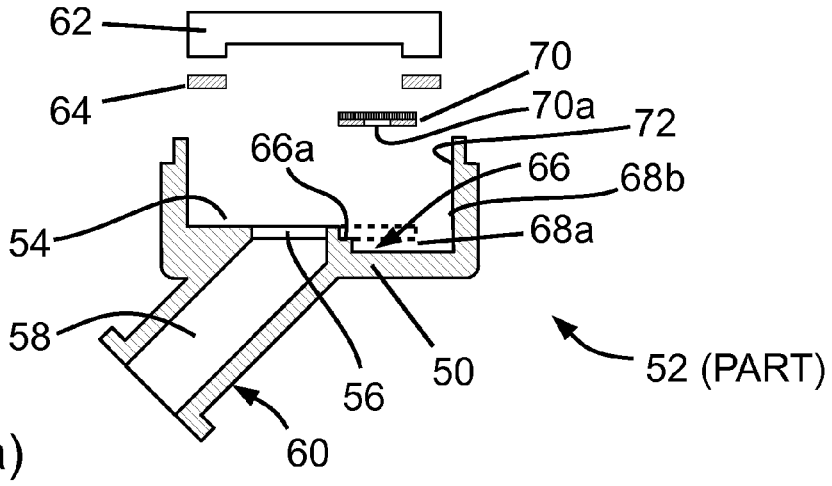
FIGS. 4(*a*) and 4(*b*) show, in partially exploded cross-section and in plan views respectively, part of an earphone arrangement in accordance with one example of the invention.
Figure 4B:
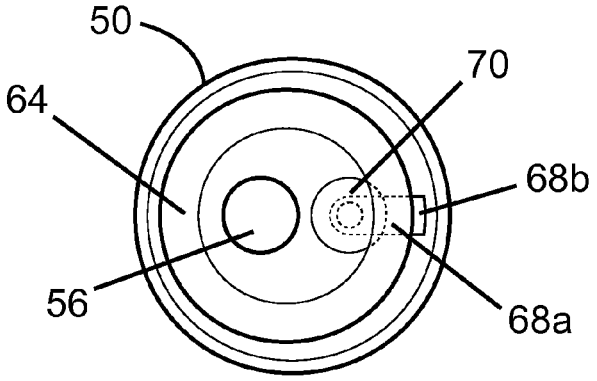

FIG. 4(*a*) shows, in somewhat simplified form, an exploded cross-section through the front housing 50 of an earphone 52 in accordance with one example of the invention. FIG. 4(*b*) shows the front housing 50 and its contents in plan view.

Referring now to FIG. 4(*a*) the front housing 50 is formed with a substantially planar internal support surface 54 which is formed with a through-aperture 56 constituting an inner opening to an outlet port 58 in an elongate ear-canal extension 60. A microspeaker 62 is located on the surface 54, so as to project sound through the aperture 56, and it is sealed onto the support surface 54 by means of a thin annular mounting ring 64 made from double-sided adhesive foam rubber. Typically, for example, the microspeaker 62 is 10 mm in diameter, and the adhesive mounting ring 64 has an outer diameter of 10 mm and an inner diameter of 7 mm.

The support surface 54 is also formed, beside the aperture 56, with a recess 66 which underlies a portion of the microspeaker 62 and the base of the recess 66 is formed with, and acoustically coupled to, an upwardly-open, U-shaped channel 68*a*, running underneath the ring 64 outwards to beyond the outermost edge of the ring 64. This can best be seen in the plan-view of FIG. 4(*b*), where the channel 68*a* is shown in dashed outline. An acoustic resistor 70 is placed on a lip 66*a* of the recess 66, such that its central aperture 70*a* overlies channel 68*a* at its innermost end, and the adhesive ring 64 for mounting the microspeaker 62 partly overlies the outer edge of the resistor 70 and also the channel 68*a*, thereby sealing and completing the channel structure. The outermost end of channel 68*a* communicates directly with an orthogonal channel 68*b* which is several millimeters in length. Channel 68*b* is formed in and runs along the inside surface 72 of the rim of the front housing 50, in an upward direction in relation to the orientation of FIG. 4(*a*), and is bounded on its inner side in part by the outer rim of the microspeaker 62 and in part by the sealing/mounting ring 64. At the upper end of the channel 68*b*, i.e. at the top edge of the microspeaker 62, the channel 68*b* is exposed to the rear-volume of the earphone 52, and this point can be considered to be the coupling port (channel 68 port) between the front and rear volumes.

A preferred method of assembly is as follows.

1. The acoustic resistor 70 is mounted in place on the lip 66*a* of the recess 66 formed in the internal support surface 54 of the front housing 50.
2. The annular, self-adhesive sealing ring 64 for mounting the microspeaker 62 is adhered to the internal support surface 54 of the front housing 50.
3. The microspeaker 62 is aligned and located face-downwards on to the adhesive sealing ring 64.

The entire operation takes only a few seconds, and forms reliable acoustic seals. It will be appreciated that a rear housing (not shown) is attached to the front housing 50, similarly to the manner in which the prior art front and rear housings 16 and 18, referenced earlier, were attached; and that the rear housing is provided with a vent, similar to the prior art vent 26 described earlier.

Figure 5:
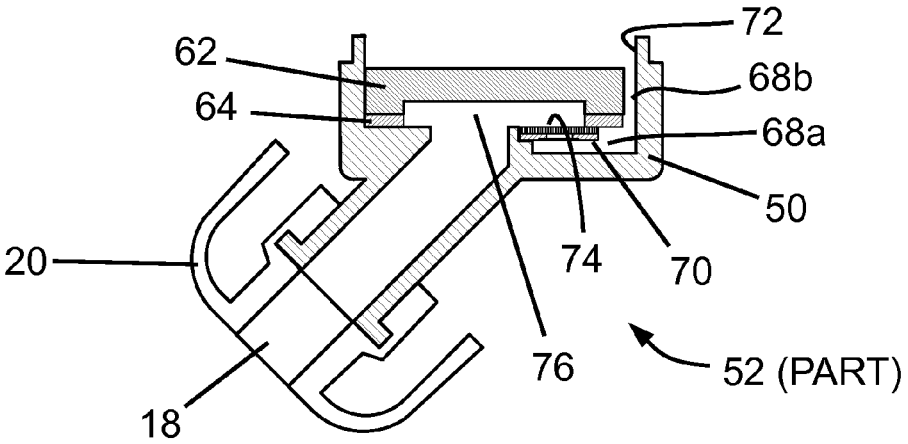
FIG. 5 is similar to FIG. 4(*a*), but shows the exploded components fully assembled.

FIG. 5 shows, similarly to FIG. 4(*a*) and with common numbering of components, the front-housing 50 of the earphone 52 after the assembly process. The uppermost face 74 of the acoustic resistor 70 is exposed to the air in the front volume 76, forming a resistive acoustic couple between it and channel 68*a*, which extends laterally underneath the microspeaker sealing ring 64, and links directly with the orthogonal channel 68*b* which opens into the rear volume (not shown) which lies to the rear of the microspeaker 62. Hence, the air in the front volume 76 is acoustically coupled, via the acoustic resistor 70 and the channels 68*a* and 68*b*, to the air in the rear volume which, as mentioned above, is vented to the external ambient.

Figure 6A:
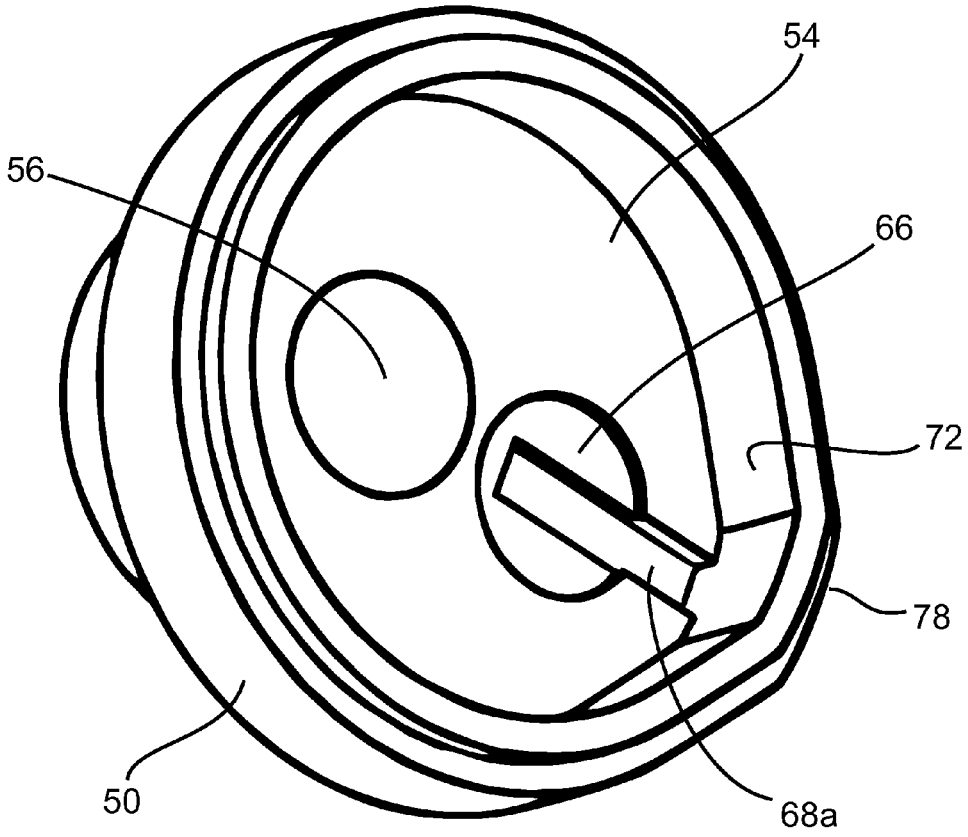
FIGS. 6(*a*), 6(*b*) and 6(*c*) show, all in similar perspective view, various stages in the assembly of the front portion of an earphone housing of the kind described with reference to FIGS. 4 and 5.
Figure 6B:
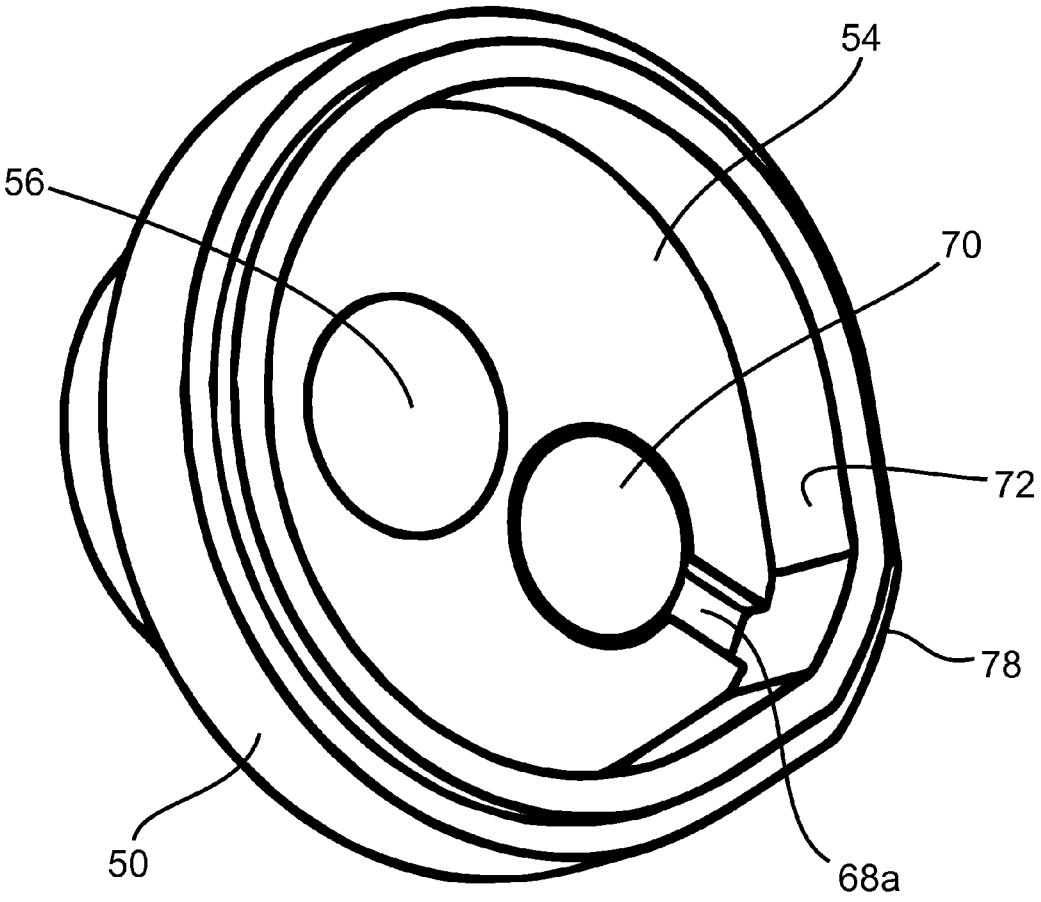
Figure 6C:
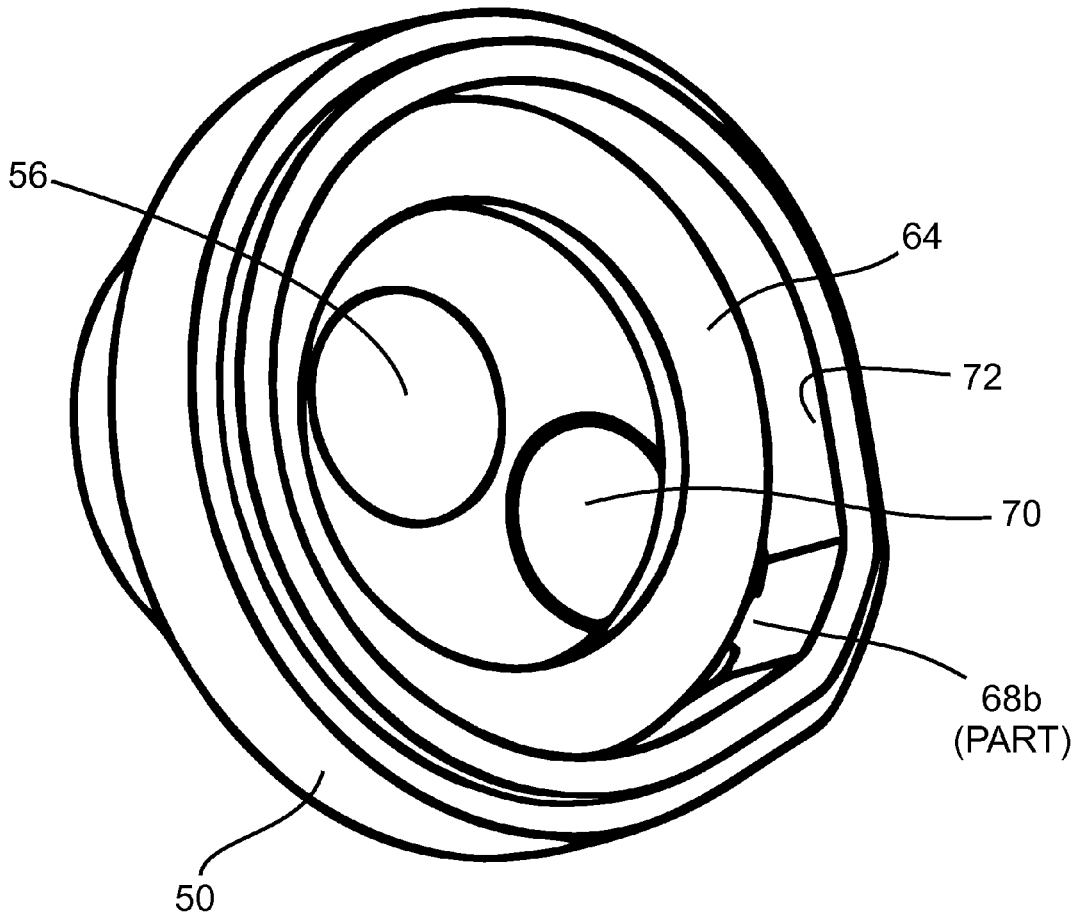

FIGS. 6(*a*), 6(*b*) and 6(*c*) show similar perspective views looking into the front housing 50 at different stages of the assembly process described.

FIG. 6(*a*) shows the front housing 50 ready for the addition of components as will be described. This view shows the shape and extent of the substantially flat support surface 54, and it shows the location and relative sizes of the outlet port aperture 56 and the recess 66 for the acoustic resistor. In the base of recess 66 can be seen the channel 68*a*. It can also be seen that, in practise, the front housing 50 is slightly non-circular, in that it is formed with a slight bulge as shown at 78; this being needed to accommodate the run of channel 68*b*.

FIG. 6(*b*) shows the front housing 50 as above, but with the acoustic resistor 70 in place and partially overlying the channel 68*a*. FIG. 6(*c*) shows the circular sealing ring 64 seated and adhering to the support surface 54 and ready to receive, support and seal in place the microspeaker 62. It can be seen in this Figure that the ring 64 overlies most of the remainder of channel 68*a*, in addition to overlying part of the acoustic resistor 70, and that the channel 68*b* runs past the rim of the ring 64 (and thus also past the rim of the microspeaker 62 when that is mounted on the ring 64).

In the example of the invention described above, the channel 68*a*, 68*b* has been shown with a minimal length. This is desirable, and preferred in many circumstances, because it minimises the acoustic inertance of the channel, which reduces any consequent resonant effects on the frequency response of the earphone.

However, a further aspect of the invention, valuable in its own right, is the capability of extending the length of the channel, thereby extending the acoustic path-length of the couple between the rear volume of the earphone and the listener's ear-canal. This facilitates the structured incorporation of a pre-determined time delay into the ambient-to-ear path, which the inventors have discovered can be particularly advantageous for ambient noise-cancelling applications.

Figure 7A:
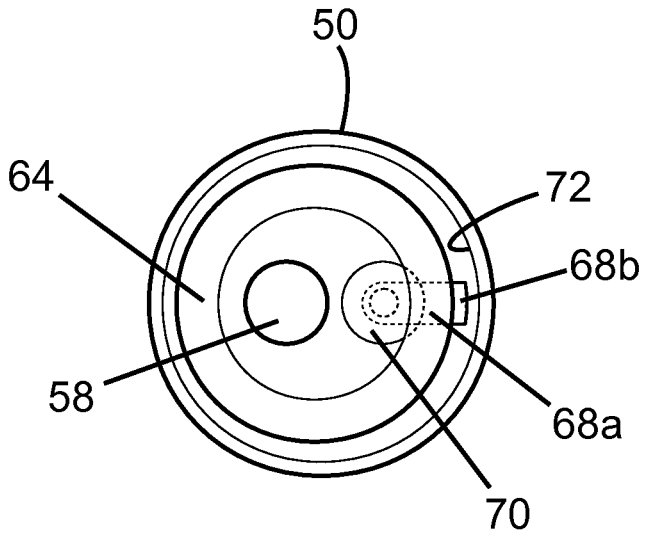
FIG. 7(*a*) is a replication of FIG. 4(*b*) for comparison with FIG. 7(*b*), which shows a plan view of an arrangement in accordance with an aspect of the invention configured to provide an extended acoustic coupling channel.
Figure 7B:
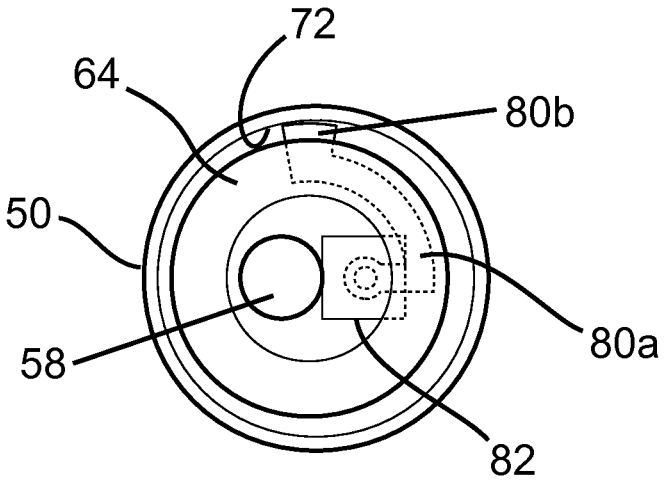

FIGS. 7(*a*) and 7(*b*) illustrate this aspect of the invention; with FIG. 7(*a*) corresponding directly to FIG. 4(*b*) and FIG. 7(*b*) showing an alternative embodiment with a channel of extended path-length. With reference to FIG. 7(*a*), the acoustic path inwards from the surrounding ambient to the ear-canal begins at a rear vent (corresponding, for example, to that shown at 26 in FIG. 1) and traverses the rear volume of the earphone 52 to the opening into channel 68*b*, then via channels 68*b* and 68*a* to and through the acoustic resistor 70, and thence to the outlet port 58 and the listener's ear-canal. The effective path-length from the opening to channel 68*b* to the outlet port 58 is thus equal to the length of channels 68*b* and 68*a* plus the resistor-to-outlet-port distance.

FIG. 7(*b*) shows an alternative embodiment, in which the coupling channel, identified as channel 80*a* and shown in dashed outline, has been lengthened by extending it around anticlockwise, underneath the microspeaker adhesive mounting ring 64, in a one-quarter circumference arc. As before, the channel 80*a* links directly to an orthogonal channel 80*b*, running up the inside wall 72 of the housing 50, but it will be appreciated that the exposed upper termination of channel 80*b* is thus located in a different position compared to that of channel 68*b*. It will also be appreciated that the bulge shown at 78 in FIGS. 6(*a*), 6(*b*) and 6(*c*) and needed to accommodate the run of channel 80*b* past the rims of the sealing ring 64 and the microspeaker 62 has to be moved through 90 degrees from the position shown in FIG. 6. The inventors have discovered that it is advantageous to position the opening of channel 80*b* as far as practicable from the rear-to-ambient vent 26 in the rear housing, in order to maximise the ambient-to-ear path length, and so it is good practise to locate the openings of channels 68*b* and 80*b* on the opposite side of the earphone 52 to the rear vent 26.

In terms of absolute dimensions, those currently employed are based on a miniature, 10 mm diameter microspeaker 62. The arc of channel 80*a* is constructed on an 8 mm diameter circle, and, subtending an angle of 90°, its length is nominally 6.3 mm, which corresponds to a sound-wave propagation time of 18.3 μs. At a frequency of 1 kHz, a propagation delay of 18.3 μs corresponds to a phase delay of 6.6°. This arcuate path-length is incremental to the other propagation paths in the system.

The acoustic resistor 82 associated with the extended channel 80*a* is shown in FIG. 7(*b*) to be square-shaped in plan, merely to indicate that the shape of the acoustic resistor (and, of course, of the recess in which it is mounted) can, if desired, be varied without departing from the scope of the invention.

Figure 8:
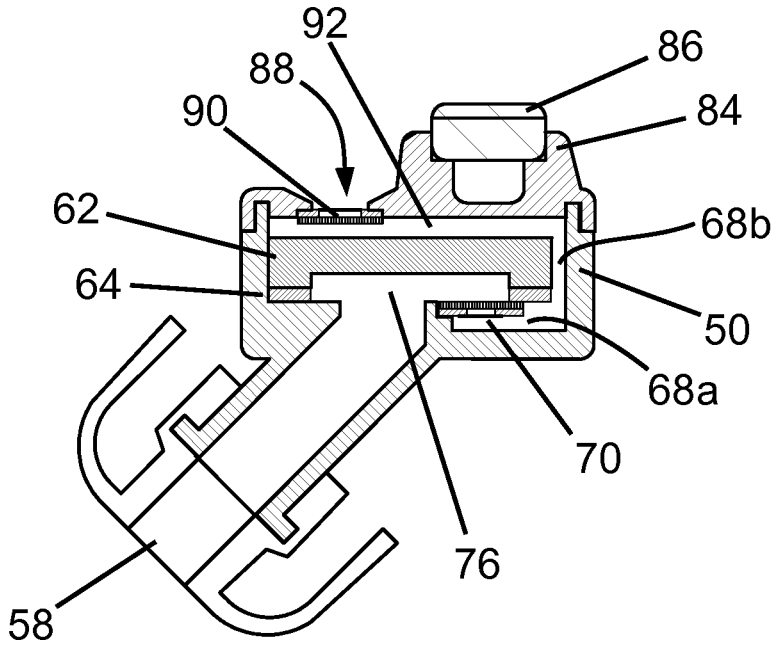
FIG. 8 shows, in cross-sectional view, an earphone arrangement in accordance with an example of the invention configured for use with an ambient noise-cancelling device.

FIG. 8 shows a front-elevation section diagram of an ambient noise-cancelling earphone featuring an embodiment of the invention as described with reference to FIGS. 4, 5 and 6, and with the additional feature of a rear housing 84 containing an electret microphone 86 and having a rear vent 88, bearing an acoustic resistor 90, between the rear volume 92 and the external ambient. An important feature is that the rear-vent 88 is located on the opposite side of the rear housing 84 to the outlet of channel 68*b* in order to maximise the ambient-to-ear-canal path length.

It will be appreciated by persons skilled in the art that the present disclosure is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the disclosure.

All references cited herein are expressly incorporated by reference in their entirety. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

The invention claimed is:

1. An earphone arrangement comprising an earphone housing having an elongate sound outlet port dimensioned and configured to locate into a listener's ear canal and bearing an external flange of resilient material thereon for intimate contact with said ear canal; the housing bearing, internally thereof, a support surface formed with an aperture therethrough communicating with said outlet port; the arrangement further including a microspeaker supported on said support surface and located to project sound through said aperture and toward said outlet; the housing comprising a front cavity in front of said microspeaker and in communication with said outlet port and a rear cavity behind said microspeaker; said support surface being further formed with a recess therein communicating with said front cavity, said recess accommodating an acoustic resistor; wherein the microspeaker overlies at least a substantial part of said recess, and the arrangement further comprises a channel linking said front and rear cavities acoustically by way of said acoustic resistor.

2. The arrangement according to claim 1, wherein the recess and the acoustic resistor therein are completely overlain by the microspeaker.

3. The arrangement according to claim 1, wherein said channel comprises a first portion formed partly in the base of said recess underlying said acoustic resistor, and a second portion, substantially orthogonal to the first, running past an edge of said microspeaker and linking the first portion to the rear cavity.

4. The arrangement according to claim 3, wherein the first portion of said channel is substantially linear, thereby minimising the overall length of the channel.

5. The arrangement according to claim 3, wherein the first portion of said channel is extended to follow an arcuate path beneath an edge of said microspeaker, thereby to extend the overall length of said channel.

6. The arrangement according to claim 1, wherein the microspeaker has a circular footprint on said support surface.

7. The arrangement according to claim 6, wherein the microspeaker is mounted on said support surface and sealed thereto by means of a double-sided adhesive ring of resilient material.

8. The arrangement according to claim 1, wherein the said aperture through said support surface is circular in plan.

9. The arrangement according to claim 1, wherein said recess and said acoustic resistor are circular in plan.

10. The arrangement according to claim 1, wherein the housing is apertured to provide a venting port to couple said rear cavity acoustically to the ambient.

11. The arrangement according to claim 10, wherein said venting port is fitted with an acoustic resistor.

12. The arrangement according to claim 10, wherein said venting port is located at a significant distance from an opening into the rear cavity of said second portion of the acoustic channel.

13. The arrangement according to claim 1, wherein the housing further accommodates a microphone means for detecting ambient noise, and said arrangement is provided with electrical connections to and from an ambient noise cancelling device.

* * * * *